United States Patent [19]

Michael

[11] 4,108,192

[45] Aug. 22, 1978

[54] METHOD FOR SEWAGE REMOVAL FROM MULTI-HOUSEHOLD CONNECTIONS

[75] Inventor: Harald Richard Michael, Hamburg, Germany

[73] Assignee: Electrolux GmbH, Germany

[21] Appl. No.: 736,209

[22] Filed: Oct. 27, 1976

[51] Int. Cl.[2] ..... E03F 1/00

[52] U.S. Cl. ..... 137/1; 137/205; 4/1

[58] Field of Search ..... 137/205, 236, 1; 4/1, 4/77

[56] References Cited

U.S. PATENT DOCUMENTS

| | | | |
|---|---|---|---|
| 3,239,849 | 3/1966 | Liljendahl | 4/1 UX |
| 3,686,693 | 8/1972 | Liljendahl | 137/205 X |

*Primary Examiner*—Alan Cohan

*Attorney, Agent, or Firm*—Larson, Taylor and Hinds

[57] ABSTRACT

A method is provided for disposing of sewage from multiple household connections. A specific volume of sewage is first collected and then suctioned off by means of a vacuum, air being released into the vacuum pipe after the sewage. The method is characterized in that the collection of the sewage takes place at each house individually and in small amounts (about 5 to 30 liters) and in that the amount of the air subsequently released into the vacuum pipe amounts to two to fifteen times the volume of the sewage.

3 Claims, No Drawings

METHOD FOR SEWAGE REMOVAL FROM MULTI-HOUSEHOLD CONNECTIONS

This invention relates to a method for sewage removal from multi-household connections in which a specified amount of sewage is initially collected and then suctioned off by means of vacuum, whereby following upon the sewage, air is released into the vacuum pipe.

Present day sewage systems, as a rule, operate on the gravity line principle, whereby when natural inclines are unfavourable, systems of this kind become extremely expensive and in some locations cannot be put into practice at all.

In addition to the above system, that of the so-called pressure discharge is also known, whereby each house is provided with a special pump. Gradients up to certain limits can be overcome, but the installations are as a rule also relatively expensive.

The removal of sewage in accordance with the method touched upon in the opening paragraph, that of vacuum pipes, is already known. In this several houses respectively are connected to a receiving tank over gravity lines, from which from time to time upon reaching certain water levels in the tank an amount of water usually around 400 liters is suctioned off. Although following the sewage, by means of delayed closure of the inlet valve, a relatively low amount of air is released into the suction pipes, the water mass is so great that it can only be accelerated very slowly and the air streaming in behind penetrates instead of driving the water before it. Apart from this the system pressure breaks down in the piping system behind the water mass, which means that here a further tank cannot be suctioned off immediately succeeding this. And finally, there also exists the disadvantage that the household sewage remains for relatively long periods first in the large collecting tanks and then in the suction pipes and hereby putrefaction occurs.

As opposed to the method illustrated in the foregoing the sewage from so-called suction toilets is not collected initially but is immediately suctioned off in small amounts of approximately 1 liter. Following this approximately 100 liter air is allowed to flow through respectively which drives the sewage in the form of a plug through a narrow, around 3 to 5 cm inside bore, pipe, before, also in this case, the water is overtaken by the air in the longer pipes. The air amount, in accordance with the known proposal is adjusted in such a way that in normal operational conditions a pipe, in which the water remains — which for its parts was overtaken by the air — in pockets once more in the form of plugs, accomodates a volume of air between the plugs, which amounts to around 10 to 50 times the volume of the water plugs. In order to maintain this relationship in the pipe one must calculate with a substantially greater ratio of air to water — possibly the stated value of 100 to 1 — during the inlet procedure, since a large proportion of the air injected is lost on the drive of the water since it penetrates this same. In the case of suction toilets the excessive amount of air is moreover required due to the concentration of polluted sewage which occurs, since the toilets and pipes are rinsed and cleansed with air instead of water. For local sewage, a system which, as in the case of suction toilets, operates with an air surplus of 100 fold, would be completely unsuitable due to the gross disparity of the required conveying capacity of the vacuum pump to the liquidity conveyance performance.

The invention has taken as its task, the creation of a method of the type mentioned which allows, by means of a relatively small vacuum pump, operation of a branched sewerage system with a large number of household connections.

The aforementioned task was carried out by means of the invention in that the collection of sewage is undertaken at each house respectively, and in relatively small amounts, around 5 to 30 liters, and the amount of air released into the suction pipe after the sewage amounts to twice to 15 times the volume of this same.

The method proposed offers the advantage that an excessive amount of air in relationship to the water volume is not allowed into the system which then must by pumped off at great investment of energy, on the other hand however a sufficiency of air to ensure rapid acceleration and disposal of the relatively limited amount of sewage, in the form of short plugs, which has collected at each house preferably in the gravity or down pipes. Based on this one can already with comparatively narrow pipe cross sections achieve a comparably greater conveyance capacity. In as much as only small amounts of water are in the suction pipes at all times, and the underpressure remains constantly effective to the furthest house connection, there is no danger that possibly polluted sewage can penetrate the ground.

In order to ensure with longer pipelines that the sewage which collect therein during the single transport procedures can be seperated into small, and consequently rapidly accelerated water plugs, it is to be recommended that a corresponding pipe laying, with alternating rising and sloping pipe lengths, cesspools or pockets takes place. With piping of this kind larger differences in height can be overcome than is normally the case with a rising pipe and with the available underpressure without that, as is the case in accordance with the known method the admixture of air to water is required in order to reduce the specific weight of the liquid.

Quite the contrary in fact the air added to the water could result in an undesirable loss of pressure.

In order to ensure during suctioning of a household connection that the mixing of water and air is delayed for as long a period as possible, in other words to ensure initially that the total amount of water collected and then the air is suctioned into the vacuum pipe through the house valve, it is planned in the preferred version of the invention, that the sewage from the gravity pipes, in which it has collected, is vacuumed over a reduced cross section in the lower reaches of this same.

The proposed method permits pipelaying corresponding with the respective site (terrain), among others also sag pipes (inverted syphons). No problems are created either when the house connecting pipes lie at levels below the backwash level. As compared with other known sewerage systems no special pumps are required.

A considerable advantage in as far as the proposed sewage system is concerned lies in the fact that all parts which in any way come into contact with the soiled water are self cleaning as a result of the rapid, turbulent flow. This prevents occurrence of the ever recurring problem of increasing sedimentation blocking pipes or valves. It is of advantage to the subsequent clarification of sewage that this same is already thoroughly aerated during transport to the sewage treatment works.

The low amounts of sewage in the system also provide the further advantage that upon opening and clearing of a house connection the vacuum available is not used for acceleration of greater amounts of water in the suction main pipes, but is, only negligibly reduced, available for rapid suction of the house connections.

A control valve and the appertaining pneumatic control mechanism, activated by the vacuum of the vacuum pipe are described in German Patent Application No. P 24 55 551.9 published as an "Offenlengungsschrift" (24 55551) on May 26, 1976.

I claim:

1. A method for the disposal of sewage from multi-household connections, the sewage from each household connection comprising the total wastewater from the household, in which a specific volume of sewage is first collected and then suctioned off by means of vacuum, and in which air is released into the vacuum pipe following the sewage, characterized in that the collection of the sewage takes place at each household respectively and in relatively small quantities about 5 to 30 liters, and in that the amount of air subsequently released into the vacuum pipe amounts to two to fifteen times the volume of the sewage.

2. A method in accordance with claim 1, characterized in that the sewage is collected in the gravity or fall pipes of each and every house and suctioned from there.

3. A method in accordance with claim 2, characterized in that the sewage from the gravity pipes is suctioned off over a reduced cross section in the lower reaches of the same.

* * * * *